US009988583B2

(12) United States Patent
Morishima et al.

(10) Patent No.: US 9,988,583 B2
(45) Date of Patent: Jun. 5, 2018

(54) HIGHLY AROMATIC BASE OIL AND METHOD FOR PRODUCING HIGHLY AROMATIC BASE OIL

(71) Applicant: JX NIPPON OIL & ENERGY CORPORATION, Tokyo (JP)

(72) Inventors: Yoshiyuki Morishima, Tokyo (JP); Takashi Ito, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 0 days. days.

(21) Appl. No.: 15/261,003

(22) Filed: Sep. 9, 2016

(65) Prior Publication Data

US 2016/0376510 A1 Dec. 29, 2016

Related U.S. Application Data

(62) Division of application No. 14/386,446, filed as application No. PCT/JP2013/050032 on Jan. 7, 2013, now Pat. No. 9,476,006.

(30) Foreign Application Priority Data

Mar. 21, 2012 (JP) ..... 2012-063978
Sep. 21, 2012 (JP) ..... 2012-208413

(51) Int. Cl.

| | |
|---|---|
| ***C10G 45/00*** | (2006.01) |
| ***C10G 45/68*** | (2006.01) |
| ***C10M 105/06*** | (2006.01) |
| ***C10M 105/52*** | (2006.01) |
| ***C10G 67/06*** | (2006.01) |

(52) U.S. Cl.
CPC ..... *C10G 45/68* (2013.01); *C10G 67/06* (2013.01); *C10M 105/06* (2013.01); *C10M 105/52* (2013.01); *C10G 2300/1048* (2013.01); *C10G 2400/10* (2013.01); *C10G 2400/30* (2013.01); *C10M 2203/065* (2013.01); *C10M 2211/0206* (2013.01)

(58) Field of Classification Search
CPC ..... C10M 105/06; C10M 105/52; C10M 2203/065; C10M 2211/0206; C10G 45/68; C10G 2300/1048; C10G 2400/10; C10G 67/06
See application file for complete search history.

(56) References Cited

U.S. PATENT DOCUMENTS

| | | | | |
|---|---|---|---|---|
| 3,506,566 A | | 4/1970 | Haney | |
| 5,152,883 A | | 10/1992 | Melin et al. | |
| 5,759,385 A | * | 6/1998 | Aussillous | C10M 175/005 208/174 |
| 2011/0086755 A1 | | 4/2011 | Iino et al. | |
| 2013/0172639 A1 | | 7/2013 | Yanagawa | |

FOREIGN PATENT DOCUMENTS

| | | |
|---|---|---|
| CN | 1351114 | 5/2002 |
| CN | 102311784 | 1/2012 |
| CN | 102365322 | 2/2012 |
| CN | 102365323 | 2/2012 |
| EP | 2 258 476 | 12/2010 |
| JP | 2004-155959 | 6/2004 |
| JP | 2010-229314 | 10/2010 |
| JP | 2010-229316 | 10/2010 |
| JP | 2011-042734 | 3/2011 |
| SG | 174122 | 10/2011 |
| SG | 174123 | 10/2011 |
| TW | 200950883 A | 12/2009 |
| WO | 2009/119390 | 10/2009 |
| WO | 2010/110144 A | 9/2010 |
| WO | 2011/139008 A | 11/2011 |

OTHER PUBLICATIONS

International Search Report of Patent Application No. PCT/JP2013/050032 dated Feb. 12, 2013.
English translation of the International Preliminary Report on Patentability for PCT/JP2013/050032, which was dated Sep. 23, 2014.
Chinese Office Action for Application No. 201380015380.X, dated Jun. 3, 2015.
Extended European Search Report for EP Patent Application No. 13763750.0, which was dated Mar. 23, 2015.
Japanese Office Action in respect to Japanese Application No. 2012-208413, dated May 9, 2017.
Taiwanese Office Action in respect to Taiwanese Application No. 102103342, dated Sep. 22, 2017.
European Office Action in respect to European Application No. 13763750.0, dated Nov. 30, 2016.
Shell, Clarified Oil (Safety Data Sheet), May 17, 2011, XP055320672.
European Office Action in respect to European Application No. 13763750.0, dated Oct. 10, 2017.

* cited by examiner

*Primary Examiner* — Cephia D Toomer
(74) *Attorney, Agent, or Firm* — Greenblum & Bernstein, P.L.C.

(57) ABSTRACT

A method for producing a highly aromatic base oil of the present invention includes a step of hydrorefining a clarified oil to obtain a highly aromatic base oil having an aromatic content of 50% by mass or more determined by a column chromatography analysis method. The step of hydrorefining a clarified oil is preferably performed under conditions of a hydrogen pressure of 5.0 to 20.0 MPa, a temperature of 280 to 400° C., a hydrogen oil ratio of 300 to 750 NL/L, and a space velocity of 0.3 to 2.0 $h^{-1}$. According to the present invention, a highly aromatic base oil used for rubber processing, asphalt reclamation and the like, and a novel method for producing a highly aromatic base oil can be provided.

5 Claims, No Drawings

HIGHLY AROMATIC BASE OIL AND METHOD FOR PRODUCING HIGHLY AROMATIC BASE OIL

The present application is a Divisional Application of U.S. application Ser. No. 14/386,446, filed Sep. 19, 2014, which is a National Stage of International Patent Application No. PCT/JP2013/050032 filed Jan. 7, 2013, which claims priority to Japanese Application No. 2012-208413 filed Sep. 21, 2012 and Japanese Application No. 2012-063978 filed Mar. 21, 2012. The disclosures of U.S. application Ser. No. 14/386,446 and International Patent Application No. PCT/JP2013/050032 are incorporated by reference herein in their entireties.

TECHNICAL FIELD

The present invention relates to a method for producing a highly aromatic base oil, and more specifically relates to a highly aromatic base oil used for rubber processing, asphalt reclamation and the like, and a method for producing the highly aromatic base oil.

BACKGROUND ART

In the production of rubber compositions such as natural rubber and synthetic rubber, a highly aromatic mineral oil is used because it has high affinity for a rubber constituent, imparts extensibility and workability to rubber compositions and excels economic performance. For example, an extender oil is compounded into synthetic rubber such as SBR in its synthesis, and a process oil is compounded into a processed product of rubber such as a tire so as to improve its workability and quality of the processed product of rubber (for example, Patent Literature 1).

In Patent Literature 1, the use of petroleum process oil having the content of aromatic hydrocarbon ($C_A$ of ASTM D3238 (n-d-M analysis method)) of 20 to 35% by weight, the glass-transition temperature $T_g$ of −55° C. to −30° C., and the kinematic viscosity at 100° C. of 20 to 50 $mm^2/s$ is proposed. When rubber obtainable by compounding this petroleum process oil into diene rubber is used for a tire, both of a fuel-efficient property and a grip property may be achieved, and heat aging resistance and heat abrasion resistance may be improved.

Furthermore, regarding asphalt pavement, in order to reclaim deteriorated and solidified asphalt when recycling asphalt scrap collected in repair of a paved road, a highly aromatic mineral oil such as a rubber compounding oil is used as a reclamation additive, and a process oil having a high aromatic content is required so as to improve a reclamation effect with small amount of addition.

Rubber compounding oils include mineral oils having various compositions, and rubber compounding oils derived from extract are known (for example, Patent Literature 2). However, since extract is generally produced by lubricant oil production equipment, there is a limit on its production volume, and as demand of rubber compounding oils is increased as recycle of asphalt pavement progresses, production by other methods has been expected.

CITATION LIST

Patent Literature

Patent Literature 1: Japanese Patent Application Laid-Open No. 2004-155959

Patent Literature 2: Japanese Patent Application Laid-Open No. 2010-229314

SUMMARY OF INVENTION

Technical Problem

It is an object of the present invention to provide a highly aromatic base oil used for rubber processing, asphalt reclamation and the like, and a novel method for producing a highly aromatic base oil.

Solution to Problem

In order to solve the above-described problem, the present invention provides a highly aromatic base oil, and a method for producing the highly aromatic base oil including a step of hydrorefining a clarified oil to obtain a highly aromatic base oil having an aromatic content of 50% by mass or more determined by a column chromatography analysis method (hereinafter, for convenience, referred to as "first producing method.").

Here, "clarified oil" (hereinafter, sometimes abbreviated to "CLO") in the present invention means one obtainable by removing a catalyst from a slurry oil (SLO) distilled from a bottom of a fluid catalytic cracking device (FCC) through a catalyst separation device.

According to the above-described first producing method, a highly aromatic base oil used for rubber processing, asphalt reclamation and the like may be easily and reliably obtainable.

The above-described step of hydrorefining a clarified oil is preferably performed under conditions of a hydrogen pressure of 5.0 to 20.0 MPa, a temperature of 280 to 400° C., a hydrogen oil ratio of 300 to 750 NL/L, and a space velocity of 0.3 to 2.0 $h^{-1}$. By hydrorefining the clarified oil under such conditions, the highly aromatic base oil in which the aromatic content satisfies the above-described condition may be more reliably obtainable.

Moreover, the present invention provides a method for producing a mixed-base oil including a first step of hydrorefining a clarified oil to obtain a highly aromatic base oil having an aromatic content of 50% by mass or more determined by a column chromatography analysis method, and a second step of mixing the highly aromatic base oil and one or more base oils selected from a mineral oil and a synthetic oil other than the highly aromatic base oil to obtain a mixed-base oil having an aromatic content of 50% by mass or more determined by a column chromatography analysis method, an aniline point of 100° C. or less, % $C_A$ of 20 to 80 according to ASTM D2140, a pour point of ±10° C. or less, a glass-transition point of −30° C. to −60° C., and a rate of aromatic carbon of 0.1 to 0.5 (hereinafter, for convenience, referred to as "second producing method").

According to the above-described second producing method, a beneficial effect that a highly aromatic base oil used for rubber processing, asphalt reclamation and the like may be easily and reliably obtainable is exhibited in the same manner as the first producing method.

In addition, in Europe, the regulations that any substances containing a specific amount or more of a dimethylsulfoxide (DMSO) extraction component or specific carcinogenic polycyclic aromatic compounds must not be used for producing tires or tire components has been applied since 2010, and rubber compounding oils conforming to these regulations have been demanded. Here, the specific carcinogenic polycyclic aromatic compounds mean the following eight aromatic compounds (collectively referred to as "specific aromatic compounds"; hereinafter, also described as 8PAHs.).

1) benzo(a)pyrene (abbreviated to BaP)
2) benzo(e)pyrene (abbreviated to BeP)
3) benzo(a)anthracene (abbreviated to BaA)
4) chrysene (abbreviated to CHR)
5) benzo(b)fluoranthene (abbreviated to BbFA)
6) benzo(j)fluoranthene (abbreviated to BjFA)
7) benzo(k)fluoranthene (abbreviated to BkFA)
8) dibenzo(a,h)anthracene (abbreviated to DBAhA)

According to the above-described second producing method, the content of the above-described aromatic compounds 1) to 8) in the mixed-base oil obtainable after the second step may be sufficiently reduced.

In the above-described second producing method, the mixed-base oil obtainable in the second step has preferably a content of benzo(a)pyrene of 1 ppm by mass or less, and a total content of the following aromatic compounds 1) to 8):

1) benzo(a)pyrene,
2) benzo(e)pyrene,
3) benzo(a)anthracene,
4) chrysene,
5) benzo(b)fluoranthene,
6) benzo(j)fluoranthene,
7) benzo(k)fluoranthene, and
8) dibenzo(a,h)anthracene of 10 ppm by mass or less.

Moreover, the present invention provides a highly aromatic base oil obtainable by the above-described first producing method, in which the highly aromatic base oil has an aromatic content of 50% by mass or more determined by a column chromatography analysis method, an aniline point of 60° C. or less, % $C_A$ of 30 to 80 according to ASTM D2140, a pour point of +10° C. or less, a kinematic viscosity at 40° C. of 100 $mm^2/s$ or more, a glass-transition point of −30° C. to −60° C., and a rate of aromatic carbon of 0.1 to 0.5 (hereinafter, referred to as "first highly aromatic base oil" for convenience).

Furthermore, the present invention provides a mixed-base oil containing the above-described first highly aromatic base oil and one or more base oils selected from a mineral oil and a synthetic oil other than the highly aromatic base oil, in which the mixed-base oil has an aromatic content of 50% by mass or more determined by a column chromatography analysis method, an aniline point of 100° C. or less, % $C_A$ of 20 to 80 according to ASTM D2140, a pour point of +10° C. or less, a glass-transition point of −30° C. to −60° C., and a rate of aromatic carbon of 0.1 to 0.5.

The above-described mixed-base oil has preferably a content of benzo(a)pyrene of 1 ppm by mass or less, and a total content of the following aromatic compounds 1) to 8):

1) benzo(a)pyrene,
2) benzo(e)pyrene,
3) benzo(a)anthracene,
4) chrysene,
5) benzo(b)fluoranthene,
6) benzo(j)fluoranthene,
7) benzo(k)fluoranthene, and
8) dibenzo(a,h)anthracene of 10 ppm by mass or less.

Moreover, the present invention provides a method for producing a highly aromatic base oil including a step of hydrorefining a clarified oil to obtain a highly aromatic base oil having an aromatic content of 50% by mass or more determined by a column chromatography analysis method, an aniline point of 60° C. or less, a content of benzo(a) pyrene of 1. ppm by mass or less, and a total content of the following aromatic compounds 1) to 8):

1) benzo(a)pyrene,
2) benzo(e)pyrene,
3) benzo(a)anthracene,
4) chrysene,
5) benzo(b)fluoranthene,
6) benzo(j)fluoranthene,
7) benzo(k)fluoranthene, and
8) dibenzo(a,h)anthracene of 10 ppm by mass or less (hereinafter, for convenience, referred to as "third producing method").

The above-described step of hydrorefming a clarified oil in the third producing method is preferably performed under conditions of a hydrogen pressure of 10.0 to 20.0 MPa, a temperature of 280 to 400° C., a hydrogen oil ratio of 300 to 750 NL/L, and a space velocity of 0.3 to 2.0 $h^{-1}$.

Moreover, the present invention provides a method for producing a mixed-base oil including a first step of hydrorefining a clarified oil to obtain a highly aromatic base oil having an aromatic content of 50% by mass or more determined by a column chromatography analysis method, an aniline point of 60° C. or less, a content of benzo(a) pyrene of 1 ppm by mass or less, and a total content of the following aromatic compounds 1) to 8):

1) benzo(a)pyrene,
2) benzo(e)pyrene,
3) benzo(a)anthracene,
4) chrysene,
5) benzo(b)fluoranthene,
6) benzo(j)fluoranthene,
7) benzo(k)fluoranthene, and
8) dibenzo(a,h)anthracene of 10 ppm by mass or less, and a second step of mixing the highly aromatic base oil and one or more base oils selected from a mineral oil and a synthetic oil other than the highly aromatic base oil to obtain a mixed-base oil having an aromatic content of 50% by mass or more determined by a column chromatography analysis method, an aniline point of 100° C. or less, % $C_A$ of 20 to 80 according to ASTM D2140, a pour point of +10° C. or less, a glass-transition point of −30° C. to −60° C., a rate of aromatic carbon of 0.1 to 0.5, a content of benzo(a)pyrene of 1 ppm by mass or less, and a total content of the following aromatic compounds 1) to 8):

1) benzo(a)pyrene,
2) benzo(e)pyrene,
3) benzo(a)anthracene,
4) chrysene,
5) benzo(b)fluoranthene,
6) benzo(j)fluoranthene,
7) benzo(k)fluoranthene, and
8) dibenzo(a,h)anthracene of 10 ppm by mass or less (hereinafter, for convenience, referred to as "fourth producing method").

Moreover, the present invention provides a highly aromatic base oil obtainable by the above-described third producing method, in which the highly aromatic base oil has an aromatic content of 50% by mass or more determined by a column chromatography analysis method, an aniline point of 60° C. or less, % $C_A$ of 30 to 80 according to ASTM D2140, a pour point of +10° C. or less, a kinematic viscosity at 40° C. of 100 $mm^2/s$ or more, a glass-transition point of −30° C. to −60° C., a rate of aromatic carbon of 0.1 to 0.5, a content of benzo(a)pyrene of 1 ppm by mass or less, and a total content of the following aromatic compounds 1) to 8):

1) benzo(a)pyrene,
2) benzo(e)pyrene,
3) benzo(a)anthracene,
4) chrysene, 5) benzo(b)fluoranthene,
6) benzo(j)fluoranthene,
7) benzo(k)fluoranthene, and
8) dibenzo(a,h)anthracene of 10 ppm by mass or less (hereinafter, for convenience, referred to as "third highly aromatic base oil").

Furthermore, the present invention provides a mixed-base oil containing the above-described third highly aromatic base oil and one or more base oils selected from a mineral oil and a synthetic oil other than the highly aromatic base oil, in which the mixed-base oil has an aromatic content of 50% by mass or more determined by a column chromatography analysis method, an aniline point of 100° C. or less, % $C_A$ of 20 to 80 according to ASTM D2140, a pour point of +10° C. or less, a glass-transition point of −30° C. to −60° C., a rate of aromatic carbon of 0.1 to 0.5, a content of benzo(a)pyrene of 1 ppm by mass or less, and a total content of the following aromatic compounds 1) to 8):

1) benzo(a)pyrene,
2) benzo(e)pyrene,
3) benzo(a)anthracene,
4) chrysene,
5) benzo(b)fluoranthene,
6) benzo(j)fluoranthene,
7) benzo(k)fluoranthene, and
8) dibenzo(a,h)anthracene of 10 ppm by mass or less.

Moreover, the present invention provides a method for producing a highly aromatic base oil including a first step of hydrorefining a clarified oil to obtain a hydrorefined oil, and a second step of fractionation-treating and/or adsorption-treating the hydrorefined oil to obtain a highly aromatic base oil having an aromatic content of 50% by mass or more determined by a column chromatography analysis method, a content of benzo(a)pyrene of 1 ppm by mass or less, and a total content of the following aromatic compounds 1) to 8):

1) benzo(a)pyrene,
2) benzo(e)pyrene,
3) benzo(a)anthracene,
4) chrysene,
5) benzo(b)fluoranthene,
6) benzoj)fluoranthene,
7) benzo(k)fluoranthene, and
8) dibenzo(a,h)anthracene of 10 ppm by mass or less (hereinafter, for convenience, referred to as "fifth producing method").

The first step of hydrorefining a clarified oil in the fifth producing method is preferably performed under conditions of a hydrogen pressure of 5.0 to 20.0 MPa, a temperature of 280 to 400° C., a hydrogen oil ratio of 300 to 750 NL/L, and a space velocity of 0.3 to 2.0 $h^{-1}$.

Moreover, the present invention provides a method for producing a mixed-base oil including a first step of hydrorefining a clarified oil to obtain a hydrorefined oil, a second step of fractionation-treating and/or adsorption-treating the hydrorefined oil to obtain a highly aromatic base oil having an aromatic content of 50% by mass or more determined by a column chromatography analysis method, a content of benzo(a)pyrene of 1 ppm by mass or less, and a total content of the following aromatic compounds 1) to 8):

1) benzo(a)pyrene,
2) benzo(e)pyrene,
3) benzo(a)anthracene,
4) chrysene,
5) benzo(b)fluoranthene,
6) benzo(j)fluoranthene,
7) benzo(k)fluoranthene, and
8) dibenz,o(a,h)anthracene of 10 ppm by mass or less, and a third step of mixing the highly aromatic base oil and one or more base oils selected from a mineral oil and a synthetic oil other than the highly aromatic base oil to obtain a mixed-base oil having an aromatic content of 50% by mass or more determined by a column chromatography analysis method, an aniline point of 100° C. or less, % $C_A$ of 20 to 80 according to ASTM D2140, a pour point of +10° C. or less, a glass-transition point of −30° C. to −60° C., a rate of aromatic carbon of 0.1 to 0.5, a content of benzo(a)pyrene of 1 ppm by mass or less, and a total content of the following aromatic compounds 1) to 8):

1) benzo(a)pyrene,
2) benzo(e)pyrene,
3) benzo(a)anthracene,
4) chrysene,
5) benzo(b)fluoranthene,
6) benzo(j)fluoranthene,
7) benzo(k)fluoranthene, and
8) dibenzo(a,h)anthracene of 10 ppm by mass or less (hereinafter, for convenience, referred to as "sixth producing method").

Moreover, the present invention provides a highly aromatic base oil obtainable by the above-described fifth producing method, in which the highly aromatic base oil has an aromatic content of 50% by mass or more determined by a column chromatography analysis method, an aniline point of 60° C. or less, % $C_A$ of 30 to 80 according to ASTM D2140, a pour point of +10° C. or less, a glass-transition point of −30° C. to −60° C., and a rate of aromatic carbon of 0.1 to 0.7 (hereinafter, for convenience, referred to as "fifth highly aromatic base oil").

Furthermore, the present invention provides a mixed-base oil containing the above-described fifth highly aromatic base oil and one or more base oils selected from a mineral oil and a synthetic oil other than the highly aromatic base oil, in which the mixed-base oil has an aromatic content of 50% by mass or more determined by a column chromatography analysis method, an aniline point of 100° C. or less, % $C_A$ of 20 to 80 according to ASTM D2140, a pour point of +10° C. or less, a glass-transition point of −30° C. to −60° C., and a rate of aromatic carbon of 0.1 to 0.5.

Advantageous Effects of Invention

As described above, according to the present invention, a highly aromatic base oil used for rubber processing, asphalt reclamation and the like, and a novel method for producing a highly aromatic base oil may be provided.

Furthermore, a highly aromatic base oil including 1 ppm by mass or less of benzo(a)pyrene and 10 ppm by mass or less of 8 PAHs, and a method for producing a highly aromatic base oil may also be provided.

DESCRIPTION OF EMBODIMENTS

Hereinafter, a preferred embodiment of the present invention will be described.

A method for producing a highly aromatic base oil according to the embodiment of the present invention includes a step of hydrorefining a clarified oil (CLO) to obtain a highly aromatic base oil having an aromatic content of 50% by mass or more determined by a column chromatography analysis method (hydrorefining step).

CLO as a raw oil may be obtainable by removing a catalyst fi-om a slurry oil (SLO) distilled from a bottom of a fluid catalytic cracking device (FCC) through a catalyst separation device. The raw oil for FCC is not particularly limited and may be either a vacuum gas oil or an atmospheric residue, but a vacuum gas oil is preferable.

The kinematic viscosity of CLO at 40° C. is preferably 100 $mm^2/s$ or more and 500 $mm^2/s$ or less, more preferably 110 $mm^2/s$ or more and 480 $mm^2/s$ or less, and further preferably 120 $mm^2/s$ or more and 450 $mm^2/s$ or less. If the kinematic viscosity is less than the above-described lower limit, physical properties of rubber products tend to be decreased, and if it exceeds the above-described upper limit, a working property in rubber compounding tends to be deteriorated.

Moreover, the sulfur content in CLO is preferably less than 1.5% by mass, more preferably less than 1.0% by mass, and further preferably less than 0.5% by mass. If the sulfur content is 1.5% by mass or more, lifetime of the catalyst used for hydrorefining tends to be shortened.

Moreover, the nitrogen content in CLO is preferably less than 0.3% by mass, more preferably less than 0.2% by mass, and further preferably less than 0.1% by mass. If the nitrogen content is 0.3% by mass or more, lifetime of the catalyst for hydrorefining tends to be shortened.

Moreover, the rate of aromatic carbon of CLO is preferably 0.30 or more, more preferably 0.40 or more, and further preferably 0.50 or more. If the rate of aromatic carbon is less than 0.30, aromaticity of the base oil obtainable after hydrorefining tends to be insufficient. Here, "rate of aromatic carbon" in the present invention means a ratio of the number of aromatic carbons to the number of all carbons, and is determined as follows by $^{13}C$ NMR rate of aromatic carbon =(the number of aromatic carbons)/(the number of all carbons)

=(integrated value: 100 ppm to 170 ppm)/[(integrated value: 100 ppm to 170 ppm)+(integrated value: 8 ppm to 58 ppm)]

Measurement conditions of $^{13}C$-NMR are as follows.

used instrument: NMR system 500 type NMR instrument manufactured by Varian, Inc.

measurement method: $^{1}H$-gated decoupling method (NNE method)

pulse width: 30° pulse spectrum width: −50 ppm to 250 ppm cumulated number: 800 times waiting time: 10 sec LB: 10 Hz chemical shift standard: internal standard ($CDCl_3$: 77.1 ppm)

Furthermore, regarding distillation characteristics of CLO, it is preferable that the 80% distillation temperature he 400° C. or more and the end point be 500° C. or more in a gas chromatograph distillation method. In the case where the 80% distillation temperature is less than 400° C. or the end point is less than 500° C. in the gas chromatograph distillation method, a heavy component content in the obtained highly aromatic base oil (hydrogenated oil) tends to be decreased, and sufficient hardness may not be imparted to rubber when being used as a rubber compounding oil.

A hydrorefining device that is common in petroleum refining may be used for hydrorefining of CLO. The structure of the hydrorefining device is not particularly limited, and a reactor may be used singly or in combination thereof Hydrogen may be additionally injected between a plurality of reactors, and vapor-liquid separation operation or hydrogen sulfide removal equipment may be included.

As a reaction form of a hydrotreating device, a fixed-bed system is preferably adopted, hydrogen may be flow in a faun of either countercurrent flow or co-current flow with respect to a raw oil, and a plurality of reactors in combination with countercurrent flow and co-current flow may be also used. A common form is downflow, and gas-liquid co-current flow form is preferable. For the purpose of removing reaction heat and increasing a hydrogen partial pressure, hydrogen gas may be injected as quench to the middle of a reactor.

As a catalyst used for a hydrotreating step, a common hydrorefining catalyst may be applied, and the catalyst is not particularly limited insofar as it satisfies intended characteristics. For example, the catalyst used for hydrotreating is a hydrogenation active metal supported by a porous support, and examples of the porous support include inorganic oxides. As the active metal, generally, metals of group 6 and group 8 of the periodic table are preferably used, and for example, a Ni—Mo system, a Ni—Co—Mo system, and the combination thereof are preferably used. As the support, porous inorganic oxides containing alumina as a major ingredient are used. Specific examples of the inorganic oxides include alumina, titania, zirconia, boria, silica, and zeolite, and in the present invention, among them, an inorganic oxide composed of a combination of at least one of titania, zirconia, boria, silica and zeolite, and alumina, or composed of an alumina simple substance is preferable. A producing method thereof is not particularly limited, and an arbitrary preparing method using raw materials corresponding to the respective elements, in states such as various sols and salt compounds may be adopted. After once preparing complex hydroxides and complex oxides such as silica alumina, silica zirconia, alumina titania, silica titania, and alumina boria, addition of alumina gel or other hydroxides, or an appropriate solution may be performed at an arbitrary step in preparing steps. The ratio of alumina to other oxides may be an arbitrary rate based on the porous support, and alumina is preferably 50% or more, further preferably 60% or more, and more preferably 70% or more.

For treating conditions in the hydrorefining step, the reaction temperature is preferably 400° C. or less, more preferably 380° C. or less, and more preferably 370° C. or less because a certain level of low temperature is favorable to a hydrogenation reaction. Furthermore, it is preferably 280° C. or more, more preferably 300° C. or more, and most preferably 310° C. or more because a certain level of high temperature is favorable to a desulfurization reaction.

The hydrogen pressure is preferably 5.0 MPa or more, more preferably 7.0 MPa or more, and further preferably 10.0 MPa or more because the higher hydrogen pressure accelerates both of the desulfurization and hydrogenation reactions. Furthermore, the economically optimum point exists, and it is preferably 20.0 MPa or less, and more preferably 18.0 MPa or less.

The hydrogen/oil ratio is preferably 300 or more, more preferably 350 or more, and most preferably 400 or more because the higher hydrogen/oil ratio accelerates both of the desulfurization and hydrogenation reactions. Furthermore, the economically optimum point exists, and it is preferably 750 or less, more preferably 700 or less, and most preferably 500 or less.

LHSV is preferably 2.0 $h^{-1}$ or less, and more preferably 1.5 $h^{-1}$ or less because the lower LHSV is favorable to the reaction. Furthermore, too low LHSV becomes unfavorable because extremely large reactor volume is needed to result in huge equipment investment, and therefore, it is preferably 0.3 $h^{-1}$ or more, and more preferably 0.5 $h^{-1}$ or more.

Excessive hydrorefining is not desirable because of excessively removing an aromatic component, and it is preferable to balance the above-described reaction conditions such that the obtained highly aromatic base oil has the aromatic content of 50% by mass or more determined by a column chromatography analysis method.

The aromatic content determined by a column chromatography analysis method of the highly aromatic base oil obtainable by the above-described hydrorefining is, as described above, 50% by mass or more, and preferably 60% by mass or more. The aromatic component less than 50% by mass determined by on a column chromatography analysis method is not preferable because physical properties of rubber products are decreased when the base oil is used as a rubber compounding oil.

Furthermore, the obtained highly aromatic base oil has preferably the following characteristics.

The aniline point of the highly aromatic base oil is 100° C. or less, preferably 85° C. or less, more preferably 75° C. or less, further preferably 60° C. or less, and most preferably 50° C. or less. If the aniline point exceeds 100° C., compatibility with rubber tends to be decreased when the base oil is used as a rubber compounding oil.

% $C_A$ of the highly aromatic base oil according to a structural group analysis method (ASTM D2140) is 20 to 80, preferably 25 to 80, more preferably 30 to 70, further more preferably 33 to 70, and most preferably 36 to 70. In both cases where % $C_A$ is less than 20 and exceeds 80, physical properties of rubber products tend to be decreased when the base oil is used as a rubber compounding oil.

% $C_N$ of the highly aromatic base oil according to a structural group analysis is preferably 40 or less, and more preferably 35 or less. If % $C_N$ exceeds 40, the aromatic component content tends to be excessively decreased to thereby fail to obtain necessary aromaticity.

The pour point of the highly aromatic base oil is preferably 10° C. or less, more preferably 0° C. or less. If the pour point exceeds 10° C., a working property in rubber compounding tends to be decreased when the base oil is used as a rubber compounding oil.

The kinematic viscosity of the highly aromatic base oil at 40° C. is preferably 30 $mm^2/s$ or more, more preferably 100 $mm^2/s$ or more, further preferably 105 $mm^2/s$ or more, and most preferably 111 $mm^2/s$ or more. If the kinematic viscosity at 40° C. is less than 30 $mm^2/s$, the viscosity of rubber products after compounding tends to be decreased when the base oil is used as a rubber compounding oil.

The glass-transition point of the highly aromatic base oil is preferably −60° C. to −30° C., and more preferably −55° C. to −40° C. In both cases where the glass-transition point is less than −60° C. and exceeds −30° C., physical properties of rubber products tend to be decreased when the base oil is used as a rubber compounding oil.

The rate of aromatic carbon of the highly aromatic base oil is 0.1 or more, preferably 0.12 or more, and more preferably 0.15 or more. Furthermore, the rate of aromatic carbon of the highly aromatic base oil is 0.7 or less, more preferably 0.6 or less, and further preferably 0.45 or less.

If the rate of aromatic carbon is less than 0.1 or exceeds 0.7, physical properties of rubber products tend to be decreased when the base oil is used as a rubber compounding oil.

Furthermore, the rate of aromatic carbon of the highly aromatic base oil is preferably lower than the rate of aromatic carbon of CLO as a raw material by 0.10 or more, more preferably by 0.12 or more, and further preferably by 0.15 or more. If the rate of aromatic carbon of the highly aromatic base oil is lower than the rate of aromatic carbon of CLO as a raw material by 0.10 or more, additional effects of good compatibility with rubber and capable of imparting physical properties suitable for rubber products are exhibited.

The sulfur content of the highly aromatic base oil is preferably 0.01% by mass or more, more preferably 0.03% by mass or more, and preferably 0.05% by mass or more. If the sulfur content is less than 0.01% by mass, physical properties of rubber products tend to be decreased.

Bay-Proton of the highly aromatic base oil is preferably 1.0% or less, more preferably 0.7% or less, further preferably 0.5% or less, and most preferably 0.35% or less.

Bay-Proton of the highly aromatic base oil more than 1.0% is not preferable because a polycyclic aromatic compound having a carcinogenic property is likely to be contained.

The residual carbon content of the highly aromatic base oil is preferably 5.0% by mass or less, and more preferably 3.0% by mass or less. If the residual carbon content exceeds 5% by mass, physical properties of rubber products tend to be decreased when the base oil is used as a rubber compounding oil.

A mixed-base oil may be formed by mixing further one or more oils selected from a mineral oil and a synthetic oil other than the highly aromatic base oil into the highly aromatic base oil. The mixing amount of the base oils (mineral oil and/or synthetic oil) other than the highly aromatic base oil is arbitrary insofar as it does not impair characteristics as a rubber compounding oil, and it is, on the basis of the total amount of the mixed-base oil, preferably 80% by mass or less, more preferably 70% by mass or less, and most preferably 60% by mass or less.

Characteristics of the mineral oil and the synthetic oil as the base oils other than the highly aromatic base oil are not particularly limited. The kinematic viscosity at 100° C. is preferably 1 to 200 $mm^2/s$, more preferably 2 to 150 $mm^2/s$, and further preferably 4 to 100 $mm^2/s$.

Examples of the mineral oil include distillate of vacuum distillation, a base oil and an extract derived from a deasphalted oil of a vacuum distillation residue, wax isomerization base oil, and GTL (gas to liquids) base oil. Examples of the synthetic oil include polybutene, poly-α-olefin, olefin copolymer, alkylbenzene, alkylnaphthalene, alkyldiphenylalkane, polyalkylene glycol, polyphenyl ether, alkyldiphenyl ether, ester, silicone oil, and fluorinated polyether.

According to the above-described producing method, the content of specific aromatic compounds (8PAHs.) in the obtained highly aromatic base oil may be sufficiently reduced, and in the case of further reducing the content of the specific aromatic component, it is preferable that fractionation-treating and/or adsorption-treating be further performed for the highly aromatic base oil. Accordingly, the highly aromatic base oil including 1 ppm by mass or less of benzo(a)pyrene and 10 ppm by mass or less of the specific aromatic compounds (8PAHs.) may be more reliably obtainable.

A method of the fractionation-treating is not particularly limited, and atmospheric distillation and vacuum distillation may be performed. Distillation is varied depending on the theoretical plate number or the like, and generally, regarding distillate, the 99% distillation temperature of gas chromatograph distillation is preferably 510° C. or less, more preferably 500° C. or less, and further preferably 490° C. or less.

In particular, since benzo(e)pyrene (boiling point 493° C.) remains in many cases, it is most preferable that conditions capable of sufficiently removing this be set. In particular, it is most preferable that conditions capable of sufficiently removing benzo(e)pyrene (boiling point 493° C.) be set by selecting distillation conditions and a fraction to be removed.

A method of the adsorption-treating is not particularly limited, and a batch type, a column type and the like may be used. In addition, an adsorbent is not particularly limited, and activated white earth, silica gel, activated alumina, synthetic zeolite, activated carbon, amorphous iron hydroxide and the like may be used.

The content of Benzo(a)pyrene in the highly aromatic base oil and the mixed-base oil is preferably 5 ppm by mass or less, and more preferably 1 ppm by mass or less. Moreover, the content of the specific aromatic compounds (8PAHs.) are preferably 200 ppm by mass or less, more preferably 180 ppm by mass or less, further preferably 100 ppm by mass or less, and most preferably 10 ppm by mass or less.

The content of benzo(a)pyrene of 1 ppm by mass or less and the content of the specific aromatic compounds of 10 ppm by mass or less are most preferable because they are within the range of regulation values in Europe.

The highly aromatic base oil and the mixed-base oil obtainable in the present embodiment have high aromaticity and excel in workability and extensibility as a rubber compounding oil, a reclamation effect of asphalt, and further economic performance.

In the case where the above-described highly aromatic base oil and mixed-base oil are used for a rubber compounding oil, the content of the highly aromatic base oil and the mixed-base oil is, on the basis of the total amount of the rubber compounding oil, preferably 50% by mass or more, more preferably 70% by mass or more, and further preferably 90% by mass or more. When the content of the highly aromatic base oil is 50% by mass or more, an improvement effect of workability and extensibility as the rubber compounding oil may be effectively exhibited.

Furthermore, in the case where the above-described highly aromatic base oil and mixed-base oil are used for the rubber compounding oil, a mineral hydrocarbon oil other than the above-described base oils may be further contained as long as it does not impair characteristics of the rubber compounding oil. Examples of such a mineral hydrocarbon oil include extract and raffinate.

The method for producing a highly aromatic base oil of the present invention is not limited to the above-described embodiment. For example, the method for producing a highly aromatic base oil of the present invention may further include a step of removing a light component (light component removing step) from the highly aromatic base oil obtainable by the hydrorefining step by vacuum distillation and the like, as necessary. By including such a light component removing step, an evaporating component in rubber processing is reduced and decrease in performance of rubber for products may be suppressed.

"Density" means a density measured according to JIS K2249.

"Flash point" means a flash point measured according to JIS K2265-4.

"Kinematic viscosity" means a kinematic viscosity measured according to HS K2283.

"Pour point" means a pour point measured according to JIS K2269.

"Aniline point" means an aniline point measured according to JIS K2256.

"Sulfur content" means a sulfur content measured according to JIS K2541-3.

"Nitrogen content" means a nitrogen content measured according to JIS K2609.

"Refractive index" means a refractive index measured according to JIS K0062.

"n-d-M analysis" means % $C_A$, % $C_N$, and % $C_P$ measured according to ASTM D3238 "Standard Test Method for Calculation of Carbon Distribution and Structural Group Analysis of Petroleum Oils by the n-d-M Method".

"Structural group analysis" means % $C_A$, % $C_N$, and % $C_P$ measured according to ASTM D2140 "Standard Practice for Calculating Carbon Type Composition of Insulating Oils of Petroleum Origin".

"Column chromatography analysis" means a saturated component content, an aromatic component content, and a resin component content measured according to a column chromatography analysis method defined in ASTM D2007.

"Glass-transition point" means a glass-transition point measured according to ASTM E1356.

"Bay-Proton" is an index indicating polycyclic arornaticity of an oil measured according to ISO 21461.

"Distillation temperature" and "end point" mean "distillation temperature" and "end point" determined by gas chromatograph method defined in JIS K2254 "petroleum product-distillation test method".

"Residual carbon component content" means a residual carbon component content measured according to JIS K2270.

EXAMPLES

Hereinafter, the present invention will be described more specifically with reference to examples and comparative examples, but the present invention is not limited to the following examples.

[Raw Material CLO-A]

As a clarified oil that is a raw material of hydrorefining, an oil obtained by removing a catalyst from a slurry oil of a fluid catalytic cracking device (FCC) was provided (hereinafter, referred to as "CLO-A"). Characteristics of CLO-A are shown in Table 1.

TABLE 1

| | | CLO-A |
|---|---|---|
| Kinematic viscosity (40° C.) | $mm^2/s$ | 127 |
| (100° C.) | $mm^2/s$ | 7.89 |
| Sulfur content | % by mass | 0.38 |
| Nitrogen content | % by mass | 0.09 |
| Aniline point | ° C. | — |
| Rate of aromatic carbon | | 0.58 |
| Density (15° C.) | $g/cm^3$ | 1.028 |
| Flash point (COC) | ° C. | 190 |
| Pour point | ° C. | 12.5 |
| Glass-transition temperature (Tg) | ° C. | −50.2 |
| Column chromatography analysis | | |
| Saturated component content | % by mass | 13.0 |
| Aromatic content | % by mass | 81.2 |
| Resin content | % by mass | 5.8 |
| Distillation temperature in gas chromatograph method distillation test | | |
| IBP | ° C. | 153 |
| 5% distillation temperature | ° C. | 265 |
| 10% distillation temperature | ° C. | 317 |
| 50% distillation temperature | ° C. | 404 |
| 80% distillation temperature | ° C. | 462 |
| 90% distillation temperature | ° C. | 498 |
| 95% distillation temperature | ° C. | 529 |
| FBP | ° C. | 592 |

Examples 1 to 5

In each of Examples 1 to 3, the raw material CLO-A shown in Table 1 was hydrorefined under conditions shown in Table 2 to produce a highly aromatic base oil. Characteristics of the obtained highly aromatic base oils are shown in Table 2.

In each of Example 4 and Example 5, the raw material CLO-A shown in Table 1 was hydrorefined under conditions shown in Table 2 to produce a highly aromatic base oil conforming to the regulations in Europe. Characteristics of the obtained highly aromatic base oils are shown in Table 2.

TABLE 2

| | | | Example 1 | Example 2 | Example 3 | Example 4 | Example 5 |
|---|---|---|---|---|---|---|---|
| | Raw oil, base oil | | CLO-A | CLO-A | CLO-A | CLO-A | CLO-A |
| Hydrotreating conditions | Hydrogen pressure | MPa | 8.0 | 11.0 | 15.0 | 16.0 | 17.0 |
| | Treatment temperature | ° C. | 350 | 350 | 350 | 350 | 350 |
| | Hydrogen oil ratio | NL/L | 470 | 470 | 470 | 470 | 470 |
| | Space velocity (LHSV) | $h^{-1}$ | 0.7 | 0.7 | 0.7 | 0.7 | 0.7 |
| Characteristics | Density (15° C.) | $g/cm^3$ | 1.0017 | 0.9940 | 0.9878 | 0.986 | 0.985 |
| | Flash point (COC) | ° C. | 178 | 180 | 180 | 175 | 175 |
| | Kinematic viscosity (40° C.) | $mm^2/s$ | 123 | 117 | 112 | 111 | 110 |
| | (100° C.) | $mm^2/s$ | 7.60 | 7.44 | 7.31 | 7.28 | 7.25 |
| | Pour point | ° C. | −7.5 | −5.0 | −7.5 | −7.5 | −7.5 |
| | Aniline point | ° C. | 35.7 | 37.1 | 39.4 | 40 | 40 |
| | Sulfur content | Mass % | 0.11 | 0.10 | 0.09 | 0.09 | 0.08 |
| | Nitrogen content | Mass % | 0.05 | 0.034 | 0.02 | 0.02 | 0.10 |
| | Refractive index (20° C.) | | 1.5764 | 1.566 | 1.5571 | 1.5553 | 1.5530 |
| | n-d-M analysis (ASTM D3238) | % $C_P$ | 39.4 | 37.4 | 37.4 | 32.2 | 31.6 |
| | | % $C_N$ | 2.8 | 13.6 | 13.6 | 26.7 | 28.8 |
| | | % $C_A$ | 57.7 | 49.0 | 49.0 | 41.1 | 39.6 |
| | Structural group analysis (ASTM D2140) | % $C_P$ | 36.1 | 30.5 | 27.8 | 26.2 | 25.1 |
| | | % $C_N$ | 17.4 | 26.5 | 32.6 | 34.8 | 36.9 |
| | | % $C_A$ | 46.5 | 43.0 | 39.6 | 39.0 | 37.9 |
| | Column chromatography analysis | | | | | | |
| | Saturated component content | % by mass | 22.7 | 24.2 | 25.9 | 26.3 | 26.6 |
| | Aromatic content | % by mass | 74.4 | 73.8 | 72.8 | 72.5 | 72.2 |
| | Resin content | % by mass | 2.9 | 2.0 | 1.3 | 1.2 | 1.2 |
| | Glass-transition temperature (Tg) | ° C. | −50.5 | −50.8 | −51.6 | −51.9 | −52.2 |
| | Bay-Proton | % | | | | 0.33 | 0.30 |
| | Benzo[a]pyrene | ppm by mass | — | 1 or less | — | 1 or less | 1 or less |
| | 8PAHs. | ppm by mass | — | 78 | — | 10 or less | 10 or less |
| | Distillation temperature in gas chromatograph method distillation test | | | | | | |
| | 80% distillation temperature | ° C. | 444 | — | 436 | 433 | 429 |
| | FBP | ° C. | 552 | — | 545 | 540 | 542 |
| | Rate of aromatic carbon | | 0.43 | 0.40 | 0.35 | 0.34 | 0.33 |

Comparative Examples 1 to 4

In each of Comparative Examples 1 to 4, the following Base oil 1, Base oil 2, T-DAE, or NC-RAE was provided.

Base oil 1: paraffin-base mineral oil obtained by solvent-refining and hydrorefining lubricant oil fraction.

Base oil 2: solvent-refining extract of deasphalted oil of vacuum distillation residue.

T-DAE: Treated Distillate Aromatic Extract

NC-RAE: Non-Carcinogenic Residual Aromatic Extract (RAE containing 1 mass ppm or less of benzo(a)pyrene and 10 ppm by mass or less of 8PAHs.)

Base oil 1 in Comparative Example 1 is a base oil corresponding to a low aromatic oil 2 in Examples 1 to 4 of Patent Literature 1. Moreover, Base oil 2 in Comparative Example 2 is a base oil corresponding to an oil in Example 1 of Patent Literature 2. Each of base oils in Comparative Example 3 (T-DAE) and Comparative Example 4 (NC-RAE) has characteristics of a process oil produced from a lubricant oil fraction.

Characteristics of each of the base oils in Comparative Examples 1 to 4 are shown in Table 3.

TABLE 3

| | | | Comparative Example 1 | Comparative Example 2 | Comparative Example 3 | Comparative Example 4 |
|---|---|---|---|---|---|---|
| | Raw oil, base oil | | Base oil 1 | Base oil 2 | T-DAE | NC-RAE |
| Hydrotreating conditions | Hydrogen pressure | MPa | — | — | — | — |
| | Treatment temperature | ° C. | — | — | — | — |
| | Hydrogen oil ratio | NL/L | — | — | — | — |
| | Space velocity (LHSV) | $h^{-1}$ | — | — | — | — |
| Characteristics | Density (15° C.) | $g/cm^3$ | — | 0.9757 | 0.949 | 0.944 |
| | Flash point (COC) | ° C. | — | — | 276 | 296 |
| | Kinematic viscosity (40° C.) | $mm^2/s$ | — | 1961 | 410 | 929 |
| | (100° C.) | $mm^2/s$ | 47 | 50.7 | 21.8 | 32.8 |
| | Pour point | ° C. | — | 0 | +20 | +7.5 |
| | Aniline point | ° C. | — | 70 | 75.2 | 88.9 |
| | Sulfur content | % by mass | — | — | 3.00 | 2.72 |
| | Nitrogen content | % by mass | — | 0.15 | 0.04 | 0.09 |
| | Refractive index (20° C.) | | — | — | 1.528 | 1.523 |
| | n-d-M analysis (ASTM D3238) | % $C_P$ | — | 58.4 | 58.7 | 61.9 |
| | | % $C_N$ | — | 12.2 | 18.8 | 20.1 |
| | | % $C_A$ | 27 | 29.5 | 22.5 | 18.0 |

TABLE 3-continued

| | | Comparative Example 1 | Comparative Example 2 | Comparative Example 3 | Comparative Example 4 |
|---|---|---|---|---|---|
| Structural group analysis (ASTM D2140) | % $C_P$ | — | — | — | — |
| | % $C_N$ | — | — | — | — |
| | % $C_A$ | — | — | — | — |
| Column chromatography analysis | | | | | |
| Saturated component content | % by mass | — | — | 25.3 | 30.7 |
| Aromatic content | % by mass | — | — | 68.9 | 63.4 |
| Resin content | % by mass | — | — | 5.8 | 5.9 |
| Glass-transition temperature (Tg) | ° C. | −40 | — | −51.0 | −51.6 |
| Bay-Proton | % | | | 0.17 | 0.17 |
| Benzo[a]pyrene | ppm by mass | | | 1 or less | 1 or less |
| 8PAHs. | ppm by mass | | | 10 or less | 10 or less |
| Distillation temperature in gas chromatograph method distillation test | | | | | |
| 80% distillation temperature | ° C. | — | — | 548 | 587 |
| FBP | ° C. | — | — | 614 | 686 |
| Rate of aromatic carbon | | — | — | 0.22 | 0.17 |

Examples 6 to 9

In Example 6, a mixed-base oil was obtained by mixing the highly aromatic base oil obtained in Example 1 and Base oil 1 shown in Table 4 to fulfill the formulation shown in Table 5.

In Example 7, a mixed-base oil was obtained by mixing the highly aromatic base oil obtained in Example 3 and Base oil 1 shown in Table 4 to fulfill the formulation shown in Table 5.

In Example 8, a mixed-base oil was obtained by mixing the highly aromatic base oil obtained in Example 4, which includes less than 1 mass ppm of BaP and less than 10 mass ppm of 8PAHs., and Base oil 1 shown in Table 4 to fulfill the formulation shown in Table 5, In Example 9, a mixed-base oil was obtained by mixing the highly aromatic base oil obtained in Example 4, which includes less than 1 ppm by mass of BaP and less than 10 ppm by mass of 8PAHs., and Base oil 2 shown in Table 4 to fulfill the formulation shown in Table 5.

Characteristics of each of the mixed-base oils in Examples 6 to 9 are shown in Table 5.

TABLE 4

| | | | Base oil 1 | Base oil 2 |
|---|---|---|---|---|
| Density (15° C.) | | g/cm$^3$ | 0.887 | 0.999 |
| Flash point (COC) | | ° C. | 270 | 324 |
| Kinematic viscosity | (40° C.) | mm$^2$/s | 100 | 7888 |
| | (100° C.) | mm$^2$/s | 11.2 | 95.0 |

TABLE 4-continued

| | | Base oil 1 | Base oil 2 |
|---|---|---|---|
| Pour point | ° C. | −15 | +7.5 |
| Aniline point | ° C. | 108.6 | 56.9 |
| Sulfur content | % by mass | 0.61 | 4.28 |
| Nitrogen content | % by mass | <0.01 | 0.17 |
| Refractive index (20° C.) | | 1.488 | 1.561 |
| n-d-M analysis (ASTM D3238) | % $C_P$ | 66.1 | 56.0 |
| | % $C_N$ | 27.1 | 7.1 |
| | % $C_A$ | 6.8 | 36.9 |
| Structural group analysis (ASTM D2140) | % $C_P$ | 64.8 | 51.1 |
| | % $C_N$ | 29.1 | 15.9 |
| | % $C_A$ | 6.1 | 32.0 |
| Column chromatography analysis | | | |
| Saturated component content | % by mass | 62.6 | 10.3 |
| Aromatic content | % by mass | 36.8 | 80.2 |
| Resin content | % by mass | 0.6 | 9.5 |
| Glass-transition temperature (Tg) | ° C. | <−60 | −29.7 |
| Bay-Proton | % | 0.06 | 0.28 |
| Distillation temperature in Ras chromatograph method distillation test | | | |
| 80% distillation temperature | ° C. | 526 | 601 |
| FBP | ° C. | 574 | 706 |
| Benzo[a]pyrene | ppm by mass | 1 or less | 1 or less |
| 8PAHs. | ppm by mass | 10 or less | 10 or less |
| Rate of aromatic carbon | | 0.07 | 0.09 |

TABLE 5

| | | | Example 6 | Example 7 | Example 8 | Example 9 |
|---|---|---|---|---|---|---|
| Example 1 | | % by mass | 50 | — | — | — |
| Example 3 | | % by mass | — | 50 | — | — |
| Example 4 | | % by mass | — | — | 50 | 30 |
| Base oil 1 | | % by mass | 50 | 50 | 50 | 78 |
| Base oil 2 | | % by mass | — | — | — | 47 |
| Density (15° C.) | | g/cm$^3$ | 0.944 | 0.937 | 0.932 | 0.956 |
| Flash point (COC) | | ° C. | 208 | 214 | 210 | 235 |
| Kinematic viscosity | (40° C.) | mm$^2$/s | 110 | 105 | 92.5 | 380 |
| | (100° C.) | mm$^2$/s | 9.41 | 9.23 | 8.91 | 18.90 |
| Pour point | | ° C. | −10 | −10 | −10 | −2.5 |
| Aniline point | | ° C. | 72.2 | 74.0 | 81.5 | 74.0 |
| Sulfur content | | % by mass | 0.36 | 0.35 | 0.34 | 2.00 |
| Nitrogen content | | % by mass | — | — | 0.01 | 0.08 |

TABLE 5-continued

| | | Example 6 | Example 7 | Example 8 | Example 9 |
|---|---|---|---|---|---|
| Refractive index (20° C.) | | 1.532 | 1.573 | 0.520 | 1.536 |
| n-d-M analysis (ASTM D3238) | % $C_P$ | 55.2 | 51.9 | 54.8 | 57.5 |
| | % $C_N$ | 13.1 | 23.8 | 21.1 | 19.3 |
| | % $C_A$ | 31.7 | 24.3 | 24.1 | 28.2 |
| Structural group analysis (ASTM D2140) | % $C_P$ | 45.9 | 45.0 | 47.7 | 52.5 |
| | % $C_N$ | 22.4 | 29.1 | 26.7 | 19.3 |
| | % $C_A$ | 31.8 | 25.9 | 25.6 | 28.2 |
| Glass-transition temperature (Tg) | ° C. | −57.8 | −58.3 | −59.6 | −52.1 |
| Column chromatography (saturated) | % by mass | 42.7 | 44.3 | 43.8 | 29.3 |
| Column chromatography (aromatic) | % byu mass | 55.6 | 54.8 | 55.1 | 66.1 |
| Column chromatography (resin) | % by mass | 1.8 | 1.0 | 1.1 | 4.6 |
| Bay-Proton | % | 0.50 | 0.21 | 0.20 | 0.24 |
| Benzo[a]pyrene | ppm by mass | 1 or less | 1 or less | 1 or less | 1 or less |
| 8PAHs. | ppm by mass | 20 | 10 or less | 10 or less | 10 or less |
| Distillation temperature in gas chromatograph method distillation test | | | | | |
| 80% distillation temperature | ° C. | — | — | 501 | 550 |
| FBP | ° C. | — | — | 569 | 637 |
| Rate of aromatic carbon | | 0.25 | 0.21 | 0.21 | 0.16 |

[Examples 10, 11]

In Example 10, a highly aromatic base oil which is a distillate from initial distillation to 50 vol. % distillate was obtained by vacuum distilling the highly aromatic base oil obtained in Example 2.

In Example 11, a mixed-base oil was obtained by mixing the highly aromatic base oil obtained in Example 10 and Base oil 1 shown in Table 4 at a rate shown in Table 6.

Characteristics of each of the base oils in Examples 10 and 11 are shown in Table 6.

TABLE 6

| | | Example 10 Distillate of Example 2 (0 to 50 vol. % distillate component) | Example 11 Example 10 50% by mass, Base oil 1 50% by mass |
|---|---|---|---|
| Density (15° C.) | g/cm$^3$ | 0.971 | 0.929 |
| Flash point (COC) | ° C. | 170 | 185 |
| Kinematic viscosity (40° C.) | mm$^2$s | 33.5 | 60.9 |
| (100° C.) | mm$^2$/s | 3.85 | 6.76 |
| Pour point | ° C. | −7.5 | −12.5 |
| Aniline point | ° C. | less than 30 | 64.3 |
| Sulfur content | % by mass | 0.07 | 0.33 |
| Nitrogen content | % by mass | 0.02 | 0.01 |
| Refractive index (20° C.) | | 1.550 | 1.519 |
| n-d-M analysis (ASTM D3238) | % $C_P$ | 34.1 | 53.4 |
| | % $C_N$ | 21.2 | 21.6 |
| | % $C_A$ | 44.7 | 24.9 |
| Structural group analysis (ASTM D2140) | % $C_P$ | 33.3 | 47.4 |
| | % $C_N$ | 27.6 | 26.7 |
| | % $C_A$ | 39.1 | 25.9 |
| Glass-transition temperature (Tg) | ° C. | −48.0 | −58.5 |
| Column chromatography (saturated) | % by mass | 30.0 | 46.3 |
| Column chromatography (aromatic) | % by mass | 69.1 | 53.0 |
| Column chromatography (resin) | % by mass | 0.9 | 0.8 |
| Bay-Proton | % | 0.30 | 0.18 |
| Benzo[a]pyrene | ppm by mass | 1 or less | 1 or less |

TABLE 6-continued

| | | Example 10 Distillate of Example 2 (0 to 50 vol. % distillate component) | Example 11 Example 10 50% by mass, Base oil 1 50% by mass |
|---|---|---|---|
| 8PAHs. | ppm by mass | 10 or less | 10 or less |
| Rate of aromatic carbon | | 0.54 | 0.30 |
| Distillation temperature in gas chromatograph method distillation test | | | |
| 99% distillation temperature | ° C. | 475 | — |

The invention claimed is:

1. A method for producing a highly aromatic base oil comprising:

hydrorefining a clarified oil to obtain a hydrorefined oil; and fractionation-treating and/or adsorption-treating the hydrorefined oil to obtain a highly aromatic base oil having an aromatic content of 50% by mass or more determined by a column chromatography analysis method, a content of benzo(a)pyrene of 1 ppm by mass or less, and a total content of the following aromatic compounds 1) to 8):

1) benzo(a)pyrene,
2) benzo(e)pyrene,
3) benzo(a)anthracene,
4) chrysene,
5) benzo(b)fluoranthene,
6) benzo(j)fluoranthene,
7) benzo(k)fluoranthene, and
8) dibenzo(a,h)anthracene of 10 ppm by mass or less;

wherein the highly aromatic base oil has a kinematic viscosity at 40° C. of 100 mm$^2$/s or more.

2. The method for producing a highly aromatic base oil according to claim 1, wherein the hydrorefining the clarified oil is performed under conditions of a hydrogen pressure of 5.0 to 20.0 MPa, a temperature of 280 to 400° C., a hydrogen oil ratio of 300 to 750 NL/L, and a space velocity of 0.3 to $2.0h^{-1}$.

3. A method for producing a mixed-base oil comprising:

hydrorefining a clarified oil to obtain a hydrorefined oil;

fractionation-treating and/or adsorption-treating the hydrorefined oil to obtain a highly aromatic base oil having an aromatic content of 50% by mass or more determined by a column chromatography analysis method, a content of benzo(a)pyrene of 1 ppm by mass or less, and a total content of the following aromatic compounds 1) to 8):

1) benzo(a)pyrene,
2) benzo(e)pyrene,
3) benzo(a)anthracene,
4) chrysene,
5) benzo(b)fluoranthene,
6) benzo(j)fluoranthene,
7) benzo(k)fluoranthene, and
8) dibenzo(a,h)anthracene of 10 ppm by mass or less;

wherein the highly aromatic base oil has a kinematic viscosity at 40° C. of 100 $mm^2/s$ or more; and mixing the highly aromatic base oil and one or more base oils selected from a mineral oil and a synthetic oil other than the highly aromatic base oil to obtain a mixed-base oil having an aromatic content of 50% by mass or more determined by a column chromatography analysis method, an aniline point of 100° C. or less, % $C_A$ of 20 to 80 according to ASTM D2140, a pour point of +10° C. or less, a glass-transition point of −30° C. to −60° C., a rate of aromatic carbon of 0.1 to 0.5, a content of benzo(a)pyrene of 1 ppm by mass or less, and a total content of the following aromatic compounds 1) to 8):

1) benzo(a)pyrene,
2) benzo(e)pyrene,
3) benzo(a)anthracene,
4) chrysene,
5) benzo(b)fluoranthene,
6) benzo(j)fluoranthene,
7) benzo(k)fluoranthene, and
8) dibenzo(a,h)anthracene of 10 ppm by mass or less.

4. A highly aromatic base oil obtained by the producing method according to claim 1, wherein the highly aromatic base oil has an aromatic content of 50% by mass or more determined by a column chromatography analysis method, an aniline point of 60° C. or less, % $C_A$ of 30 to 80 according to ASTM D2140, a pour point of +10° C. or less, a glass-transition point of −30° C. to −60° C., and a rate of aromatic carbon of 0.1 to 0.7.

5. A mixed-base oil comprising the highly aromatic base oil according to claim 4 and one or more base oils selected from a mineral oil and a synthetic oil other than the highly aromatic base oil, wherein the mixed-base oil has an aromatic content of 50% by mass or more determined by a column chromatography analysis method, an aniline point of 100° C. or less, % $C_A$ of 20 to 80 according to ASTM D2140, a pour point of +10° C. or less, a glass-transition point of −30° C. to −60° C., and a rate of aromatic carbon of 0.1 to 0.5.

* * * * *